US006672279B2

(12) United States Patent
Nakayama et al.

(10) Patent No.: US 6,672,279 B2
(45) Date of Patent: Jan. 6, 2004

(54) ACCUMULATOR TYPE FUEL INJECTION APPARATUS

(75) Inventors: Shinji Nakayama, Kanagawa (JP); Susumu Kohketsu, Tokyo (JP); Keiki Tanabe, Kanagawa (JP)

(73) Assignee: Mitsubishi Jidosha Kogyo Kabushiki Kaisha, Tokyo (JP)

( * ) Notice: Subject to any disclaimer, the term of this patent is extended or adjusted under 35 U.S.C. 154(b) by 68 days.

(21) Appl. No.: 10/116,065

(22) Filed: Apr. 5, 2002

(65) Prior Publication Data

US 2002/0157644 A1 Oct. 31, 2002

(30) Foreign Application Priority Data

Apr. 5, 2001 (JP) ..... P. 2001-107479

(51) Int. Cl.[7] ..... F02M 37/04; G06F 9/06; F01N 3/23

(52) U.S. Cl. ..... 123/299; 123/467; 239/96; 60/285

(58) Field of Search ..... 239/88–96, 299–300; 123/698, 467; 60/285

(56) References Cited

U.S. PATENT DOCUMENTS 5,826,425 A * 10/1998 Rossi Sebastiano et al. .. 60/285
6,304,815 B1 * 10/2001 Morall et al. ..... 60/285
6,536,209 B2 * 3/2003 Fluga et al. ..... 60/285

* cited by examiner

*Primary Examiner*—Thomas N. Moulis
(74) *Attorney, Agent, or Firm*—Birch, Stewart, Kolasch & Birch, LLP

(57) ABSTRACT

A common-rail injection system includes a first accumulator of high pressure and a second accumulator of low pressure. The common-rail injection system includes a post injection control device for injecting additional low-pressure fuel from the second accumulator through a fuel injection nozzle after main fuel is injected. The post injection control device injects the additional fuel the injection terminates at a first timing when the fuel pressure in either fuel passage or second accumulator lowers to a predetermined value lower than that of the high-pressure fuel or at a second timing when an exhaust stroke of the engine is completed, whichever earlier.

10 Claims, 7 Drawing Sheets

ACCUMULATOR TYPE FUEL INJECTION APPARATUS

BACKGROUND OF THE INVENTION

1. Field of the Invention

This invention relates to an accumulator type fuel injection apparatus and more particularly to a fuel injection control technique for activating an exhaust emission purifier in a diesel engine.

2. Description of the Related Art

Exhaust gases emitted from a diesel engine mounted in a bus, truck, etc., contain much particulate matter (PM) as well as HC, CO, NOx, etc. A diesel particulate filter (DPF) has been put into practical use as an after-treatment device of a diesel engine. The DPF captures PM, and burns and removes the captured PM with an external heat source and an oxidation catalyst for treating HC and CO. Recently, a continuous regeneration DPF has been designed wherein a catalyst that generates $NO_2$ for supplying an oxidant to oxidize and remove PM is placed upstream of the DPF in place of the external heat source of the DPF, so as to continuously remove the PM on the DPF by the generated $NO_2$. Further, insertion of an $NO_x$ catalyst has also been designed mainly for removing $NO_x$ in an exhaust passage.

It is known that such an oxidation catalyst, a continuous regeneration DPF, or an NOx catalyst can sufficiently function only in an activated state under an atmosphere at a relatively high temperature. Therefore, in a cool mode when an engine is just started, etc., it is required not only to quickly activate the oxidation catalyst, the continuous regeneration DPF, or the NOx catalyst, but also to always hold the oxidation catalyst, the continuous regeneration DPF, or the NOx catalyst in an active state.

Various techniques disclose providing the oxidation catalyst, the continuous regeneration DPF, or the NOx catalyst with a heat source such as an electric heater, so as to warm the oxidation catalyst, the continuous regeneration DPF, or the NOx catalyst at the starting time, thereby quickly activating the oxidation catalyst, the continuous regeneration DPF, or the NOx catalyst.

However, providing such a separate heat source leads not only to complication of structure, but also to an increase in costs and is not preferred.

On the other hand, in recent years, as a fuel injection control system of a diesel engine, a common-rail injection system has been put into practical use. The common-rail injection system injects a high-pressure fuel accumulated in an accumulator into a combustion chamber by electrically controlling opening and closing an injection nozzle. The diesel engine adopting the common-rail injection system has a feature that the opening timing of the fuel injection nozzle is variable and the fuel injection timing can be set as desired. This means that the common-rail injection system makes it possible to inject fuel not only in a compression stroke, but also in all strokes of suction, expansion, and exhaust.

In order to prevent an increase in engine operation noise and $NO_x$ caused by rapid explosive combustion at the initial stage of combustion, a technique for injecting a small amount of fuel at a low pressure at the initial stage of the fuel injection cycle (initial injection) has been developed and put into practical use in the field of the common-rail injection system.

Then, a technique has been developed using the feature of the common-rail injection system. In the technique, fuel for conducting main combustion is injected before injecting additional fuel in the expansion stroke and later (post injection). Then, the additional fuel is burnt by fire in the combustion chamber or the additional fuel is caused to react with a catalyst on an exhaust passage for raising exhaust temperature, thereby raising the temperature of an oxidation catalyst, a continuous regeneration DPF, or an $NO_x$ catalyst.

To conduct the post injection, penetration of the injected fuel is strong if high-pressure fuel is injected. Thus it is feared that the fuel might adhere to the cylinder liner wall, causing oil dilution, seizure, etc., to occur. Thus, a technique for injecting low-pressure fuel for minimizing the penetration of the injected fuel has been also designed for the post injection.

However, as described above, with respect to the common-rail injection system having two accumulators for accumulating high-pressure fuel and low-pressure fuel, respectively, the post injection with the low-pressure fuel should be conducted at a low pressure as much as possible. However, since the post injection temporally lowers the fuel pressure in a fuel passage communicating with a fuel nozzle or in the accumulator having the low-pressure fuel. Therefore, it is feared that it might be made impossible to maintain a sufficient fuel pressure, regardless that fuel is injected at a predetermined low pressure in the initial injection. The insufficient fuel pressure in the initial injection cannot accomplish a target combustion in the main combustion. This result is not preferred.

Thus, in the event that the post injection raises the exhaust temperature to quickly activate an oxidation catalyst, a continuous regeneration DPF, or an NOx catalyst, a problem arises as to how the fuel pressure at the post injection time is minimized as much as possible for preventing oil dilution, seizure, etc., while a sufficient fuel pressure is provided at the initial injection time to realize favorable main combustion.

SUMMARY OF THE INVENTION

It is therefore an object of the invention to provide an accumulator type fuel injection apparatus capable of providing a sufficient fuel pressure at an initial injection time of a main combustion and minimizing fuel pressure at a post injection time as much as possible to perform post injection for raising exhaust temperature.

According to a first aspect of the present invention, there is provided an accumulator type fuel injection apparatus comprising:

- a first accumulator for accumulating high-pressure fuel having high pressure pressurized by a pump;
- a fuel injection nozzle connected to the first accumulator via a fuel passage, the fuel injection nozzle for injecting fuel into a combustion chamber of an engine;
- a change-over valve for communicating the high-pressure fuel in the first accumulator with the fuel passage and shutting off communication of the high-pressure fuel between the first accumulator and the fuel passage;
- a second accumulator connected to the fuel passage downstream of the change-over valve via a branch passage, the second accumulator for accumulating low-pressure fuel having low pressure lower than the high pressure of the high-pressure fuel in the first accumulator;
- a pressure control valve provided at one of the fuel passage downstream of the change-over valve and the second accumulator, the pressure control valve for adjusting fuel pressure in the fuel passage and the second accumulator;

an on-off valve adapted to control fuel injection from the fuel injection nozzle;

main injection control means for controlling the change-over valve and on-off valve to inject main fuel from the fuel injection nozzle during a predetermined period of time according to an operation condition of the engine; and post injection control means for controlling the on-off valve to inject additional fuel from the fuel injection nozzle, after the injection of the main fuel by the main injection control means, thereby to raise exhaust temperature of the engine, wherein the post injection control means injects the additional fuel so that the injection terminates at one of a first timing and second timing, whichever earlier, at the first timing, the fuel pressure of the one of the fuel passage and second accumulator is lowered at a predetermined pressure lower than the high-pressure in the first accumulator, and at the second timing, an exhaust stroke of the engine is completed.

In a common rail system having a first accumulator of high pressure and a second accumulator of low pressure, when main injection control means injects high-pressure fuel from the first accumulator after injecting low-pressure fuel from the second accumulator, the post injection control means injects additional fuel, thereby being burnt by flame in a combustion chamber or reacted with a catalyst in an exhaust passage to raise exhaust temperature. After termination of the fuel injection by the main injection control means, the main injection control means starts the additional fuel injection (post injection) so that the injection terminates at a first timing when the fuel pressure in either fuel passage or second accumulator lowers to a predetermined value lower than that of the high-pressure fuel or at a second timing when an exhaust stroke of the engine is completed, whichever earlier.

Accordingly, the post injection is started at the timing at which the fuel pressure in the fuel passage is higher than a predetermined low pressure, and controlled so that the fuel pressure is to be the predetermined low pressure at the timing at which the post injection ordinary ends. Thus, the predetermined low pressure is maintained when the main injection control means injects the low-pressure fuel (initial injection), and the initial pressure of the post injection becomes the minimum pressure for maintaining the predetermined pressure for the initial injection, so that penetration of the injected fuel is minimized as much as possible and the fuel is well prevented from adhering to the cylinder liner wall. Accordingly, while good main combustion is accomplished and oil dilution, seizure, etc., is well prevented, the exhaust temperature can be raised to quickly activate an after-treatment device.

Here, the reason why the post injection ends at the exhaust stroke end timing is that the post injection cannot contribute to exhaust temperature raising because the additional fuel cannot be exhausted toward an exhaust passage regardless of the post injection performed after an exhaust valve is opened. However, in this case, since the initial pressure of the post injection becomes the minimum pressure in case of the post injection performed before the exhaust stroke end timing, so that the penetration of the injected fuel is minimized as much as possible and the fuel is well prevented from adhering to the cylinder liner wall. In addition, since the fuel pressure of the fuel passage continues to be gradually reduced in an suction stroke after the exhaust stroke, the predetermined low pressure can be maintained at the initial injection timing.

According to a second aspect of the invention, there is provided an accumulator type fuel injection apparatus comprising:

a first accumulator for accumulating high-pressure fuel having high pressure pressurized by a pump;

a fuel injection nozzle connected to the first accumulator via a fuel passage, the fuel injection nozzle for injecting fuel into a combustion chamber of an engine;

a change-over valve for communicating the high-pressure fuel in the first accumulator with the fuel passage and shutting communication of the high-pressure fuel off between the first accumulator and the fuel passage;

a second accumulator connected to the fuel passage downstream of the change-over valve via a branch passage, the second accumulator accumulating low-pressure fuel having low pressure lower than the high-pressure fuel in the first accumulator;

a pressure control valve provided at one of the fuel passage downstream of the change-over valve and the second accumulator, the pressure control valve for adjusting fuel pressure in the fuel passage and the second accumulator;

an on-off valve for controlling fuel injection from the fuel injection nozzle;

main injection control means for controlling the change-over valve and on-off valve to inject main fuel from the fuel injection nozzle during a predetermined period of time according to an operation condition of the engine;

post injection control means for controlling the on-off valve to inject additional fuel from the fuel injection nozzle, after the injection of the main fuel by the main injection control means, thereby to raise exhaust temperature of the engine; and pressure adjustment means for controlling the on-off valve to supply the high-pressure fuel in the first accumulator toward the fuel passage after the post injection control means injects the additional fuel by temporarily opening the on-off valve.

For example, in case much greater fuel is required at the post injection, even if the post injection lowers the fuel pressure lower than the predetermined low pressure, the high-pressure fuel in the first accumulator is temporarily supplied to the fuel passage so that the fuel pressure in the fuel passage can easily be restored to more than the predetermined low pressure.

Accordingly, at least the predetermined low pressure can be maintained at the time of the initial injection by the main injection control means. In addition, the post injection can be performed at the timing at which the fuel pressure in the fuel passage is lowered to the predetermined low pressure, so that so that penetration of the injected fuel is minimized as much as possible and the fuel is well prevented from adhering to the cylinder liner wall. Accordingly, while good main combustion is accomplished and oil dilution, seizure, etc., is well prevented, the exhaust temperature can be raised to quickly activate an after-treatment device.

DETAILED DESCRIPTION OF THE PRESENT INVENTION

Embodiments of the invention applied to a continuous regeneration DPF will be discussed with reference to the accompanying drawings.

Figure 1:
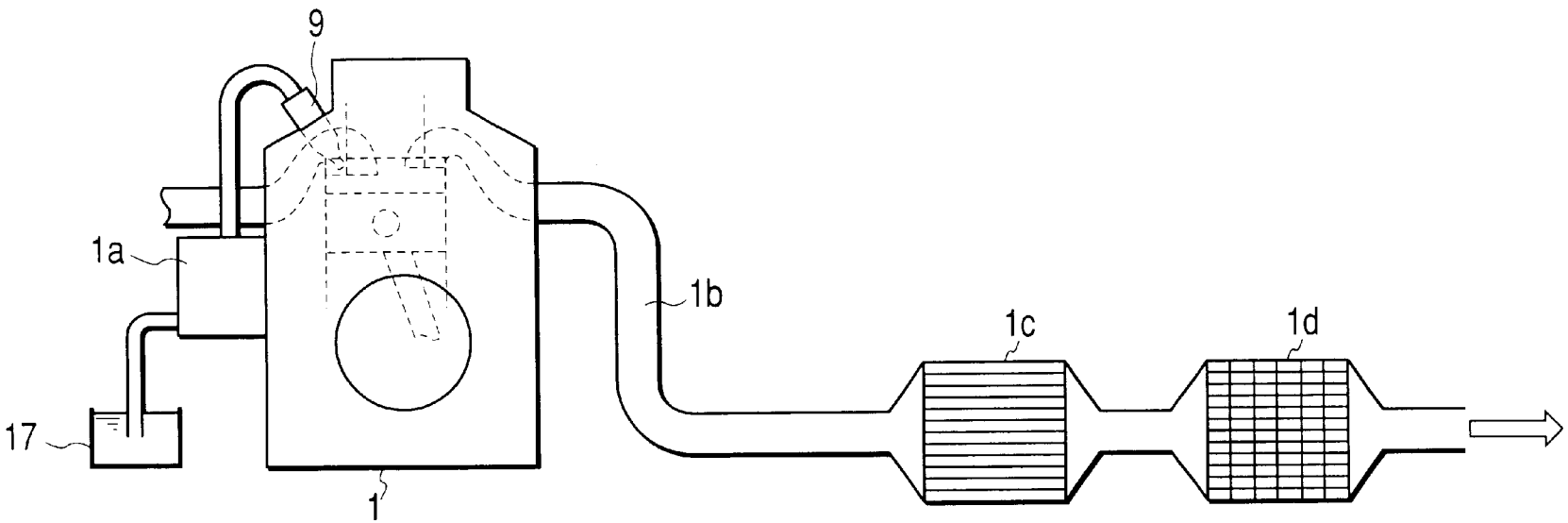
FIG. 1 is a drawing to show a diesel engine incorporating an accumulator type fuel injection apparatus according to the invention.
Figure 2:
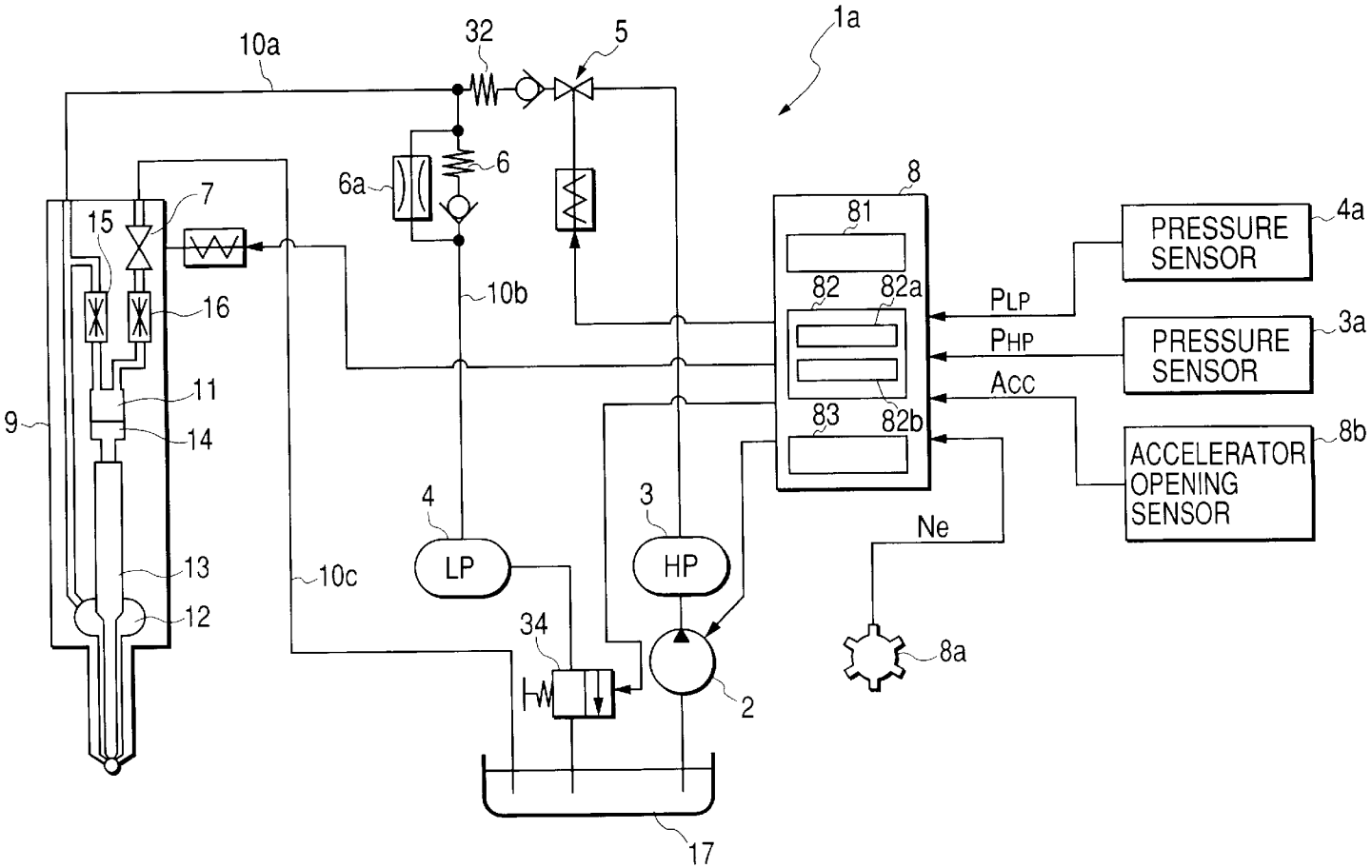
FIG. 2 is a drawing to show the configuration of the accumulator type fuel injection apparatus according to the invention.

FIG. 1 shows a diesel engine 1 incorporating an accumulator type fuel injection apparatus 1*a* according to the invention. FIG. 2 shows the configuration of the accumulator type fuel injection apparatus according to the invention.

As shown in FIG. 1, the diesel engine 1 is, for example, an in-line four-cylinder diesel engine. An after-treatment apparatus is inserted in an exhaust passage 1*b* of the engine 1. The after-treatment apparatus comprises an oxidation catalyst 1*c* placed upstream from a diesel particulate filter (DPF) 1*d*. The after-treatment apparatus having an oxidation catalyst placed upstream from a DPF is called a continuous regeneration DPF. Supplying an oxidant ($NO_2$) generated by the catalyst, the continuous regeneration DPF can continuously remove particulate matter (PM) deposited on the DPF under a relatively high temperature of exhaust gases.

As shown in FIG. 2, the accumulator type fuel injection apparatus 1*a* comprises a high-pressure pump 2 being driven by the engine 1 for pumping up and pressurizing fuel in a fuel tank 17. For example, the high-pressure pump 2 is implemented as a positive displacement plunger pump which adjusts the effective section of the pump stroke of the high-pressure pump, so as to control the fuel eject amount, to thereby the fuel pressure in a high-pressure accumulator 3 can be adjusted. To adjust the pump stroke, for example, the valve closing timing of an electromagnetic valve (not shown) is adjusted.

The fuel pressurized by the pump 2 is accumulated in the high-pressure accumulator (high-pressure common rail, first accumulator) 3. The high-pressure accumulator 3 is common to each cylinder and communicates with a fuel passage 10*a*. At a midpoint in the fuel passage 10*a*, a change-over valve 5, for example, implemented as a two-way electromagnetic valve for switching fuel injection rate is provided for each cylinder. In the fuel passage 10*a*, a check valve 32 is placed just downstream from the change-over valve 5.

The fuel passage 10*a* branches to a fuel passage 10*b* downstream from the check valve 32 and the fuel passage 10*b* is connected to a low-pressure accumulator (low-pressure common rail, second accumulator) 4 common to the cylinders. A check valve 6 is placed at a mid point in the fuel passage 10*b*. Further a bypass fuel passage is added so as to bypass the check valve 6. The bypass fuel passage is provided with an orifice 6*a*. When the fuel pressure in the fuel passage 10*a* is higher than the pressure in the fuel passage 10*b*, the fuel in the fuel passage 10*a* flows gradually into the fuel passage 10*b* through the orifice 6*a* and flows into the low-pressure accumulator 4.

A pressure control valve 34 is provided between the low-pressure accumulator 4 and the fuel tank 17.

An injector (fuel injection nozzle) 9 provided for each cylinder of the engine 1 has a control chamber 11 and a fuel chamber 12 connected to the fuel passage 10*a*. The control chamber 11 is connected to the fuel tank 17 via a fuel return passage 10*c*. Numerals 15 and 16 denote orifices and numeral 7 denotes an injection timing control on-off valve, for example, implemented as a two-way electromagnetic valve placed at a midpoint in the fuel return passage 10*c*. The on-off valve 7 may be built in the injector.

The injector 9 has a needle valve 13 for opening and closing a nozzle hole of the injector and a hydraulic piston 14 placed movably in the control chamber 11. The needle valve 13 is urged by a spring (not shown) to the nozzle hole side.

Thus, in the injector 9, fuel is supplied from the fuel passage 10*a* to the control chamber 11 and the fuel chamber 12. If the injection timing control on-off valve 7 is closed, the resultant force of the spring force of the spring and the fuel pressure is added through the hydraulic piston 14 to the needle valve 13, which then closes the nozzle hole against the fuel pressure in the fuel chamber 12. On the other hand, if the on-off valve 7 is opened and fuel in the control chamber 11 is emitted to the fuel tank 17, the needle valve 13 is moved by the fuel pressure in the fuel chamber 12 to the hydraulic piston 14 against the spring force of the spring, opening the nozzle hole for injecting the fuel in the fuel chamber 12 into a combustion chamber of the engine 1.

Connected to input of an electronic controller (ECU) 8 are various sensors including a pressure sensor 3*a* for detecting actual pressure PHP in the high-pressure accumulator 3, a pressure sensor 4*a* for detecting actual pressure PLP in the low-pressure accumulator 4, an engine rotation speed sensor 8*a* for detecting engine rotation speed Ne, and an accelerator opening sensor 8*b* for detecting accelerator pedal depress amount (accelerator opening) Acc. Connected to output of the electronic controller (ECU) 8 are various devices including the pump 2, the change-over valve 5, the on-off valve 7, and the pressure control valve 34.

Thus, the pump stroke of the pump 2 is variably adjusted in response to the engine rotation speed Ne detected by the engine rotation speed sensor 8*a* and the accelerator pedal depress amount Acc detected by the accelerator opening sensor 8*b*, for example, and further the pump stroke (fuel pressure) is subjected to feedback control in response to the actual pressure PHP in the high-pressure accumulator 3 detected by the pressure sensor 3*a*, whereby high-pressure fuel fitted to the engine operation state can be provided.

The pressure control valve 34 is controlled in response to the actual pressure PHP in the low-pressure accumulator 4 detected by the pressure sensor 4*a*, for example, whereby low-pressure fuel at predetermined low pressure PL1 fitted to the engine operation state can be provided.

As the high-pressure fuel and the low-pressure fuel fitted to the engine operation state are thus provided, the main injection time period, namely, the fuel injection time period (between fuel injection start and end timings) by the high pressure and the time period of the initial injection by the low pressure are set in response to the engine operation state (engine rotation speed Ne and accelerator pedal depress amount Acc), and then main combustion is controlled by main injection (main injection control means 81).

Figure 3:
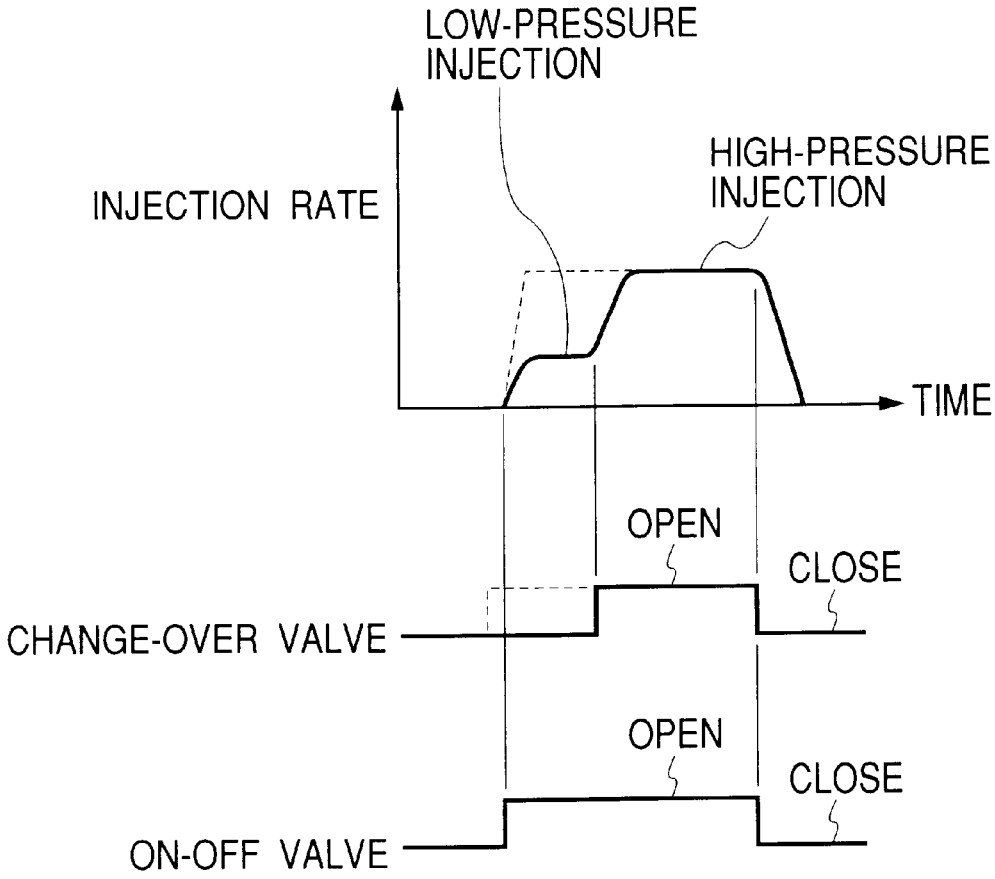
FIG. 3 is a drawing to show an injection pattern of main injection.

FIG. 3 shows time change of fuel injection rate in solid lines, which indicates an example of an injection pattern of the main injection. The injection pattern of the main injection will be discussed briefly.

Before the fuel injection start timing comes, the change-over valve 5 and the on-off valve 7 are both closed and low-pressure fuel is supplied from the low-pressure accumulator 4 to the fuel passage 10*a* downstream from the change-over valve 5 and further is supplied to the control chamber 11 and the fuel chamber 12. In this state, the on-off valve 7 is closed and thus the fuel pressure supplied to the control chamber 11 is added through the hydraulic piston 14 to the needle valve 13, which then closes the nozzle hole of the injector 9.

When the fuel injection start timing comes, only the on-off valve 7 is opened, the low-pressure fuel in the control chamber 11 is drained through the orifice 16 and the fuel return passage 10*c*, and the resultant force of the fuel pressure and the spring force of the spring added through the hydraulic piston 14 to the needle valve 13 acts so as to push up the needle valve 13. When it becomes smaller than the fuel pressure in the fuel chamber 12, the needle valve 13 rises and the nozzle hole is opened, injecting the low-pressure fuel from the injector 9. That is, the initial injection is performed at a comparatively small fuel injection rate (fuel injection amount per unit time).

As the initial injection at low pressure is thus performed, the fuel amount before ignition is lessened and the premixed combustion amount is decreased and thus the combustion at the initial stage in the fuel injection time period becomes comparatively moderate and the NOx amount in the exhaust gases is decreased.

After expiration of a predetermined time since the low-pressure injection was started, the change-over valve 5 is opened with the on-off valve 7 held open and high-pressure fuel is supplied to the fuel chamber 12 and is injected from the injector 9 (high-pressure main injection).

When the fuel injection end time is reached, the injection timing control on-off valve 7 is closed and the high-pressure fuel supplied to the control chamber 11 acts through the hydraulic piston 14 on the needle valve 13, which then closes the nozzle hole of the injector 9. The change-over valve 5 is closed as the on-off valve 7 is closed or after the expiration of a predetermined time since the fuel injection end time. Then, pressure control means 83 controls the pressure control valve 34 to maintain the fuel pressure in the low-pressure accumulator 4 to be the predetermined pressure PL1, while the fuel gradually flowing from the fuel passage 10*a* into the low-pressure accumulator 4 via the orifice 6*a* is returned to the fuel tank 17. Thus, the fuel pressure in the low-pressure accumulator 4 is adjustable.

Moreover, another injection pattern of the main injection as shown in the dotted lines of FIG. 3 will be described. When the fuel injection start timing comes, only the change-over valve 5 is opened. Then, the high-pressure fuel is supplied from the high-pressure accumulator 3, through the fuel passage 10*a* on the downstream side of the change-over valve 5, to the control chamber 11 and the fuel chamber 12. Under this condition, since the on-off valve is closed, the fuel pressure supplied into the control chamber 11 is applied to the needle valve 13 through the hydraulic piston 14, and then the nozzle hole of the injector 9 is closed by the needle valve 13. The on-off valve 7 is opened, following the open of the change-over valve 5. The high-pressure fuel in the control chamber 11 is drained through the orifice 16 and the fuel return passage 10*c*, so that the resultant force of the fuel pressure applied to the needle valve 13 via the hydraulic piston 14 and the spring force of the spring functions as pushing the needle valve 13 up. Then, when the fuel pressure in the control chamber 11 is less than the fuel pressure in the fuel chamber 12, the needle valve 13 moves upwardly to open the nozzle hole and inject the high-pressure from the injector 9. Namely, the fuel is injected by a comparatively large fuel injection rate (fuel injection amount per a unit of time). Then, the fuel injection timing comes, the on-off valve 7, the change-over valve 5, and the pressure control valve 34 are controlled as well as mentioned before.

In the above example, the pressure adjustment means 83 controls the pressure control valve 34 to variably adjust the fuel pressure in the low-pressure accumulator 4. In place thereof, the pressure control valve 34 may be composed of a pressure regulator which is not controlled by the pressure adjustment means 83. The pressure regulator adjusts the fuel pressure in the lo-pressure accumulator 4 to be a predetermined pressure.

Further, the accumulator type fuel injection apparatus 1*a* according to the invention performs post injection after the main injection for the purpose of mainly activating the oxidation catalyst by raising exhaust temperature when the exhaust system temperature is low, namely, when the continuous regeneration DPF consisting of the DPF 1*d* and the oxidation catalyst 1*c* cannot serve the continuous regeneration function (post injection control means). The control procedure of post injection control according to the invention will be discussed.

To begin with, a first embodiment will be discussed.

Figure 4:
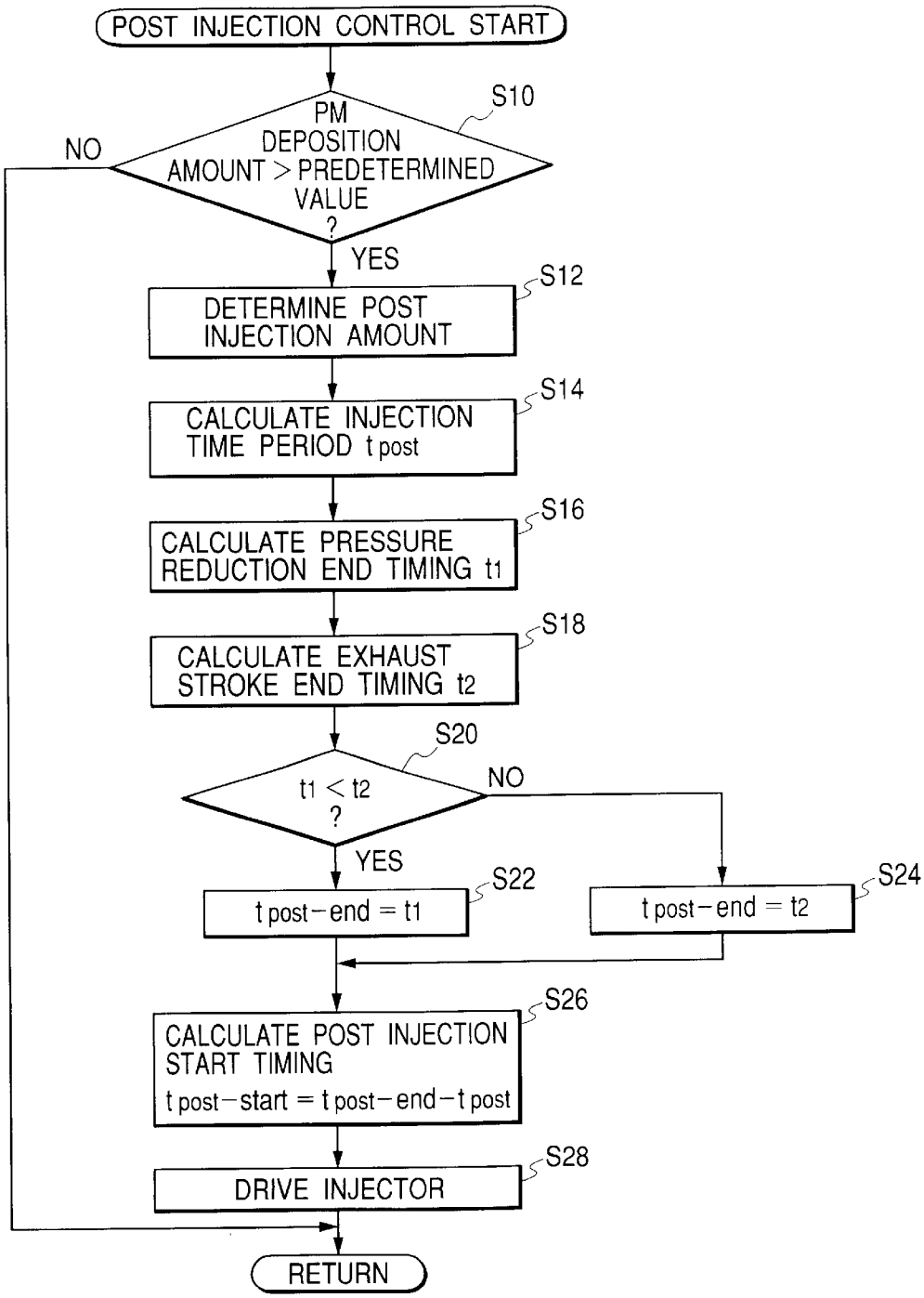
FIG. 4 is a flowchart to show a control routine of post injection control according to a first embodiment of the invention.

FIG. 4 is a flowchart to show a control routine of post injection control according to the first embodiment. The control routine will be discussed with reference to the flowchart.

At step S10, whether or not raising the exhaust temperature is required is determined based on whether or not the PM deposition amount exceeds a predetermined value.

The reason why whether or not raising the exhaust temperature is required is determined based on whether or not the PM deposition amount becomes greater than the predetermined value is that when the exhaust system temperature is low and the continuous regeneration DPF including the DPF 1*d* and the oxidation catalyst 1*c* cannot serve the continuous regeneration function, the PM deposition amount increases and as the PM deposition amount is monitored, the exhaust system temperature being low can be easily detected. In case of the exhaust temperature rising, PM is burnt and rapidly generates heat as the PM deposition amount increases. Therefore, considering the heat durability of the DPF, the predetermined value is not a great value. Determination as to whether or not raising the exhaust temperature is required may be made based on temperature information from a catalyst temperature sensor which is provided, for example.

Figure 5:
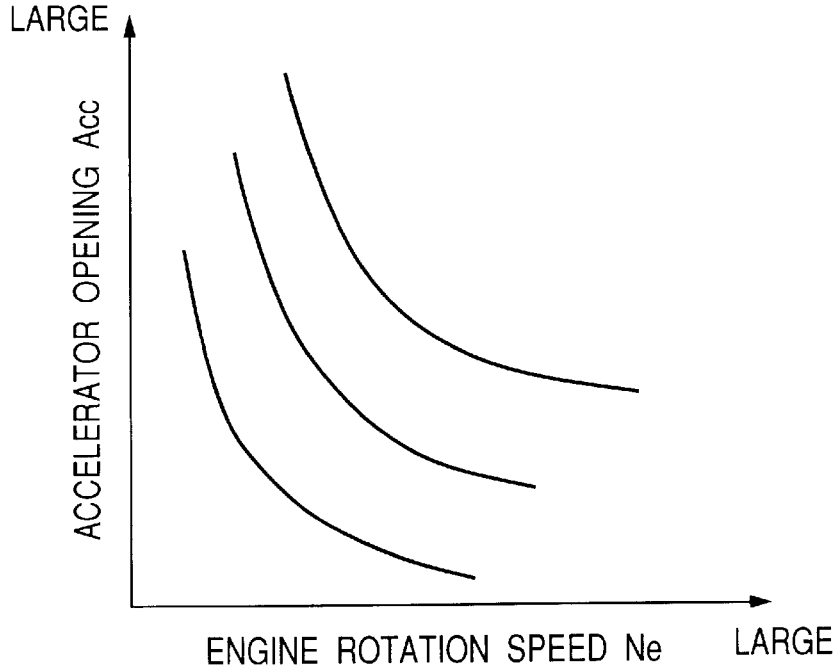
FIG. 5 is a map for determining the post injection amount.

At step S12, the post injection amount is determined based on the engine rotation speed Ne and the accelerator pedal depress amount Acc. In fact, it is determined based on a map in FIG. 5 prepared based on the engine rotation speed Ne and the accelerator pedal depress amount Acc.

At step S14, injection time period of post injection, tpost, is calculated based on the post injection amount found at step S12 and the predetermined low pressure PL1.

At step Sl6, pressure reduction end timing t1 is calculated. That is, when the change-over valve 5 is closed at the fuel injection end timing of the main injection, the high fuel pressure in the fuel passage 10*a* is not rapidly reduced and is drained gradually through the orifice 6*a* to the side of the low-pressure accumulator 4. Thus, at step S16, the pressure reduction time period until the fuel pressure reaches the predetermined low pressure PL1 through the orifice 6*a* is found and the pressure reduction end timing t1 is found from the pressure reduction time period and the fuel injection end timing of the main injection (Pressure reduction end timing calculating means 82*a*).

Figure 6:
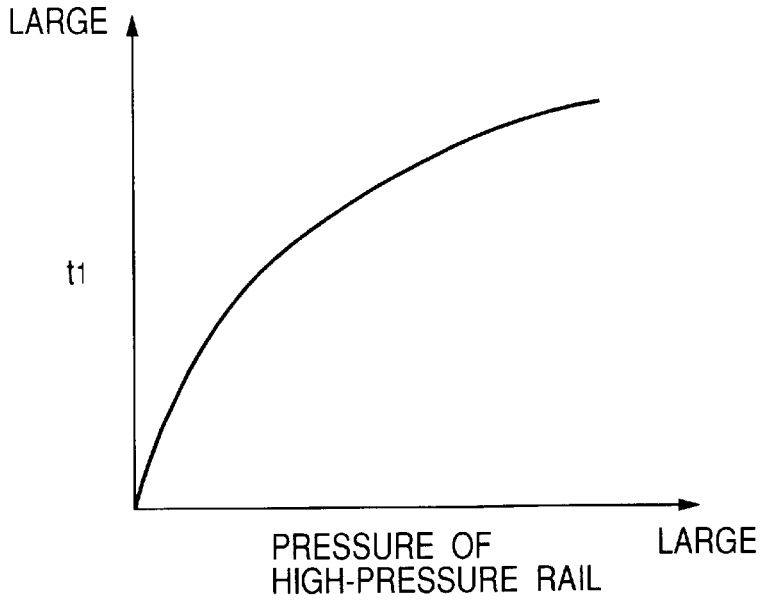
FIG. 6 is a map for determining pressure reduction end timing t1.

In fact, since the orifice 6*a* has a constant aperture, the high-pressure side pressure and the pressure reduction time period have a constant relationship and therefore the high-pressure side pressure (high-pressure rail pressure) and the pressure reduction end timing t1 also have a constant relationship. Therefore, the pressure reduction end timing t1 is read uniquely from a map shown in FIG. 6.

At step S18, exhaust stroke end timing t2 is calculated based on the engine rotation speed Ne (exhaust stroke end timing calculating means 82*b*).

At step S20, the pressure reduction end timing t1 and the exhaust stroke end timing t2 found as mentioned above are compared with each other with respect to greater-than or less-than relation. If the determination result is true (YES) and the pressure reduction end timing t1 is earlier than the exhaust stroke end timing t2, control goes to step S22 and the pressure reduction end timing t1 is set as fuel injection end timing of post injection, tpost-end.

On the other hand, if the determination result at step S20 is false (NO) and the pressure reduction end timing t1 is the same as the exhaust stroke end timing t2 or the exhaust stroke end timing t2 is earlier than the pressure reduction end timing t1, control goes to step S24 and the exhaust stroke end timing t2 is set as fuel injection end timing of post injection, tpost-end. The reason why if the exhaust stroke end timing t2 is earlier than the pressure reduction end timing t1, the exhaust stroke end timing t2 is set as the fuel injection end timing of post injection, tpost-end, is that even if post injection is executed after the exhaust valve is closed, the additional fuel provided by the post injection cannot be emitted to the exhaust passage 1*b* and cannot contribute to raising the exhaust temperature.

At step S26, the difference between the fuel injection end timing of post injection, tpost-end, thus found and the injection time period of post injection, tpost, is calculated to find start timing of post injection, tpost-start.

At step S28, post injection is executed. That is, the injector 9 is operated over the injection time period tpost at the start timing tpost-start.

Figure 7:
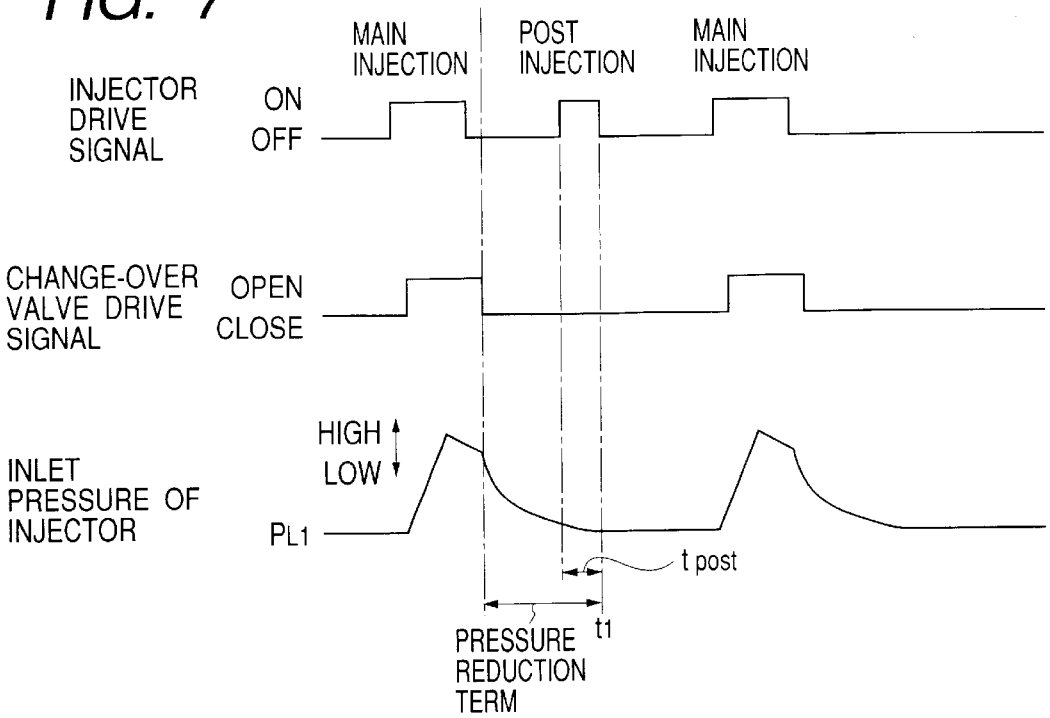
FIG. 7 is a timing chart to show time change of a drive signal of an injector, a drive signal of a change-over valve, and inlet pressure of the injector when the post injection control in FIG. 4 is executed with the pressure reduction end timing t1 set as fuel injection end timing of post injection, tpost-end.
Figure 8:
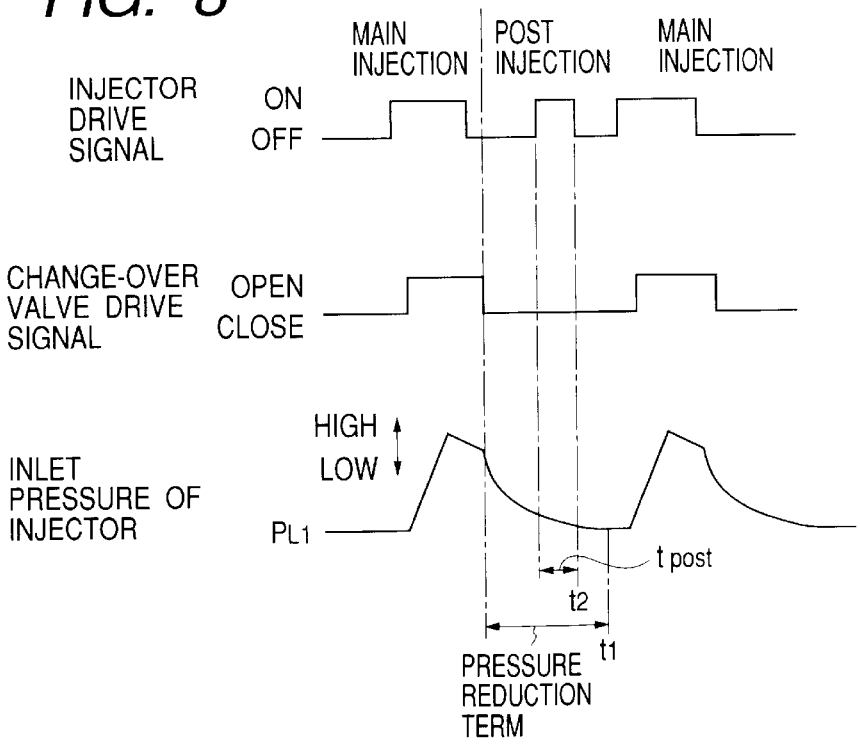
FIG. 8 is a timing chart to show time change of the drive signal of the injector, the drive signal of the change-over valve, and inlet pressure of the injector when the post injection control in FIG. 4 is executed with exhaust stroke end timing t2 set as fuel injection end timing of post injection, tpost-end.

FIGS. 7 and 8 are timing charts respectively to show time change of a drive signal of the injector 9, a drive signal of the change-over valve 5, and inlet pressure of the injector 9 when the post injection control is executed. The function and advantages according to the first embodiment of the invention will be discussed with reference to FIGS. 7 and 8. FIG. 7 shows a case that the determination result at the step 20 is "Yes", (for example, the engine rotation of the engine 1 is lower than a predetermined engine rotation), that is, the pressure reduction end timing t1 is set as the fuel injection end timing of the post injection, tpost-end. FIG. 8 shows a case that the determination result at the step 20 is "No", (for example, the engine rotation of the engine 1 exceeds a predetermined engine rotation), that is, the exhaust stroke end timing t2 is set as the fuel injection end timing of the post injection, tpost-end. In stead of the magnitude comparison between the pressure reduction end timing t1 and the exhaust stroke end timing t2 at the step 20, it may be determined at the step 20 whether the engine rotation is more than the predetermined engine rotation (Yes) or exceeds it (No). The predetermined engine rotation may be obtained from a preset map in accordance with the actual pressure PHP of the high-pressure accumulator 3.

In FIG. 7, when the drive signal of the injector 9 is turned on and the main injection is started, after the initial injection is executed, the change-over valve 5 is opened and the inlet pressure of the injector 9 is raised to high pressure, so as to perform the high-pressure main injection as described above. When the high-pressure main injection terminates and a predetermined time has elapsed since the fuel injection end timing, the change-over valve 5 is closed and the inlet pressure of the injector 9 is reduced gradually to the predetermined low pressure PL1 through the orifice 6*a*.

In this case, the post injection is started at earlier timing by injection time period tpost than the pressure reduction end timing t1 at which the inlet pressure of the injector 9 reaches the predetermined low pressure PL1. That is, if the pressure reduction end timing t1 is selected as the fuel injection end timing tpost-end, the post injection is performed so that the inlet pressure of the injector 9 reaches the predetermined low pressure PL1 at the pressure reduction end timing t1.

If the post injection is thus performed so that the inlet pressure of the injector 9 reaches the predetermined low pressure PL1 at the pressure reduction end timing t1, the inlet pressure of the injector 9, namely, the fuel pressure in the fuel passage 10*a* is held at the pressure reduction end timing t1 until the next initial injection is performed after the post injection terminates, and the initial injection is executed at appropriate fuel pressure. Accordingly, good main combustion can be accomplished.

On the other hand, if the post injection is thus performed, the start pressure of the post injection is larger than the predetermined low pressure PL1, but can hold the predetermined low pressure PL1 as the initial injection.

That is, the post injection is performed so that the inlet pressure of the injector 9 reaches the predetermined low pressure PL1 at the pressure reduction end timing t1, whereby while the predetermined low pressure PL1 is provided as the injection pressure of the initial injection, the penetration of the injected fuel can be minimized as much as possible and it is made possible to well prevent the fuel from adhering to the cylinder liner wall.

Thus, while good main combustion is accomplished and oil dilution, seizure, etc., is well prevented, the exhaust temperature is raised to quickly activate the oxidation catalyst 1*c*.

In FIG. 8, the post injection is started at earlier timing by injection time period tpost than the exhaust stroke end timing t2.

In this case, when the post injection terminates, the inlet pressure of the injector 9 is larger than the predetermined low pressure PL1. However, the inlet pressure of the injector 9 is continuously reduced gradually to the predetermined low pressure PL1 through the orifice 6*a* and thus the inlet pressure of the injector 9, namely, the pressure in the fuel passage 10*a* is continuously reduced at the next suction stroke still after the exhaust stroke terminates, and the pressure is reduced to the predetermined low pressure PL1 by the time the next initial injection is performed. Accordingly, good main combustion can also be accomplished.

As compared with the case where the pressure reduction end timing t1 is set as the fuel injection end timing tpost-end, the start pressure of the post injection is also large. Even in this case, however, the start pressure of the post injection is the minimum pressure for completing the post injection before the exhaust stroke end timing.

That is, if the exhaust stroke end timing t2 set as the fuel injection end timing tpost-end, while the predetermined low pressure PL1 is provided as the injection pressure of the initial injection, the penetration of the injected fuel can be minimized as much as possible and it is made possible to well prevent the fuel from adhering to the cylinder liner wall.

Thus, while good main combustion is accomplished and oil dilution, seizure, etc., is well prevented, the exhaust temperature is raised to quickly activate the oxidation catalyst 1*c*.

Next, a second embodiment will be discussed.

Figure 9:
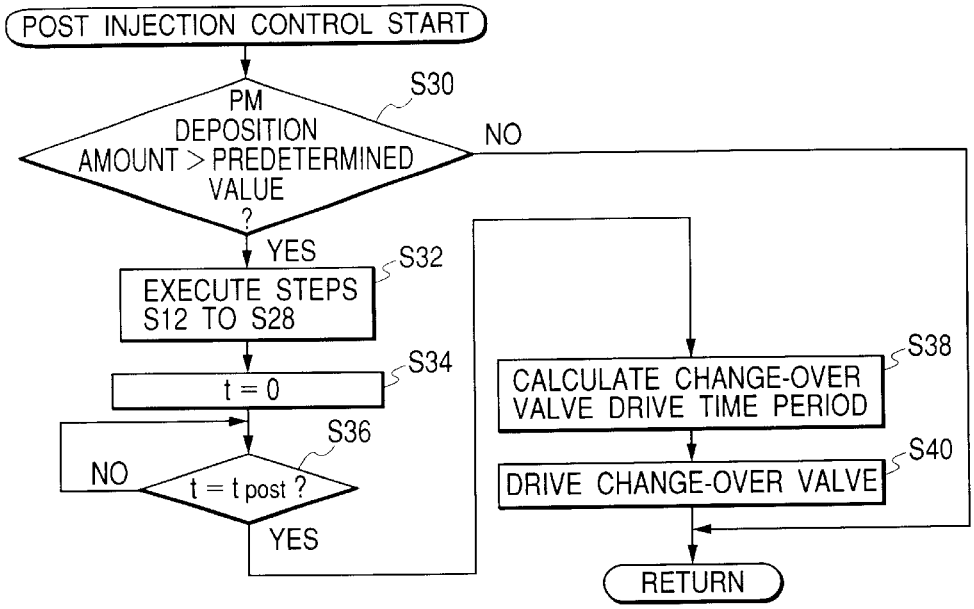
FIG. 9 is a flowchart to show a control routine of post injection control according to a second embodiment of the invention.

FIG. 9 is a flowchart to show a control routine of post injection control according to the second embodiment. The control routine will be discussed with reference to the flowchart.

At step S30, whether or not raising the exhaust temperature is required is determined based on whether or not the PM deposition amount exceeds a predetermined value as at step S10 in FIG. 4.

At step S32, steps S12 to S28 in FIG. 4 in the first embodiment are executed and the injector 9 is driven at a similar injection timing for performing post injection.

At step S34, a timer is reset (t=0) at the same time as the post injection is started, and at step S36, whether or not the count time t of the timer reaches the injection time period tpost is determined. If the determination result is false (NO), a wait is made for the count time t to reach the injection time period tpost. On the other hand, if the determination result is true (YES) and the count time t is determined to reach the injection time period tpost, control goes to step S38.

The second embodiment assumes that, for example, the post injection amount is large and the inlet pressure of the injector 9 lowers below the predetermined low pressure PL1 as the post injection is performed. After the post injection, the change-over valve 5 is temporarily opened for supplying high-pressure fuel to the fuel passage 10*a* for raising the fuel pressure in the fuel passage 10*a*.

Then, at step S38, the drive time period of the change-over valve 5 is calculated. The drive time period, namely, the valve open time may be a fixed value such that, for example, the inlet pressure of the injector 9 or the fuel pressure in the fuel passage 10*a* becomes equal to or greater than the predetermined low pressure PL1, but it is advisable to set the valve open time to the time responsive to the difference between the actual measurement value of the inlet pressure of the injector 9 or the fuel pressure in the fuel passage 10*a* and the predetermined low pressure PL1. This means that it is advisable to set the drive time period of the change-over valve 5 so that the inlet pressure of the injector 9 is restored to the predetermined low pressure PL1. In this case, as the actual measurement value of the inlet pressure of the injector 9, pressure information from the pressure sensor 4*a* can be used (pressure detection means), and the valve open time of the change-over valve 5 is set in response to the difference between the pressure information from the pressure sensor 4*a* and the predetermined low pressure PL1.

At step S40, the change-over valve 5 is opened for the drive time period found as described above after the post injection.

Figure 10:
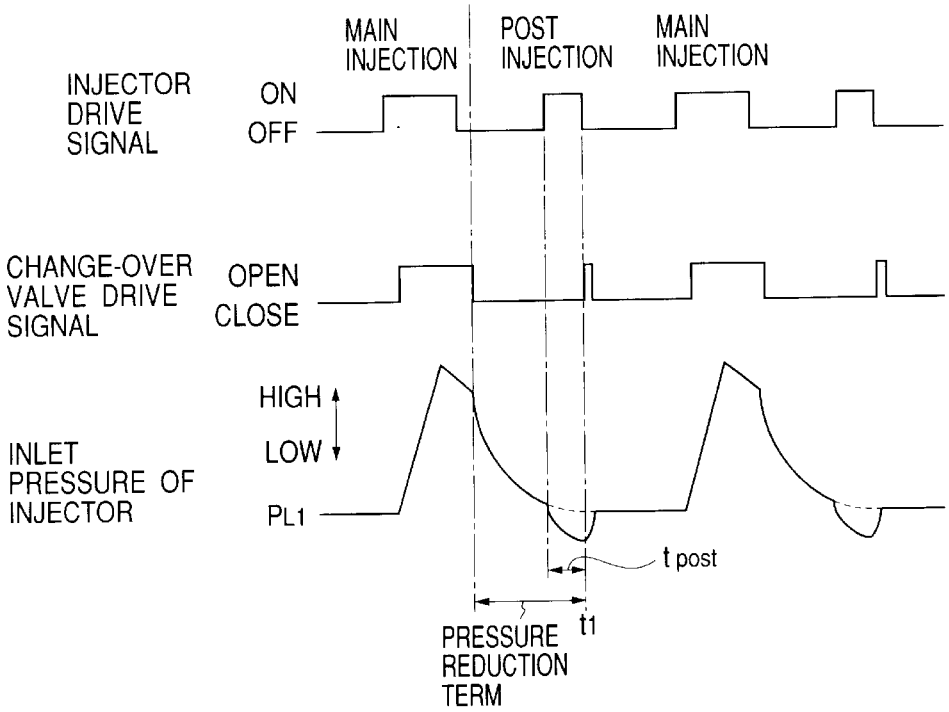
FIG. 10 is a timing chart to show time change of a drive signal of an injector, a drive signal of a change-over valve, and inlet pressure of the injector when the post injection control in FIG. 9 is executed.

FIG. 10 is a timing chart to show time change of a drive signal of the injector 9, a drive signal of the change-over valve 5, and the inlet pressure of the injector 9 when the post injection control of the second embodiment is executed. The function and advantages according to the second embodiment of the invention will be discussed with reference to FIG. 10. FIG. 10 corresponds to FIG. 7 and shows the case where the fuel injection end timing of post injection, tpost-end, is set based on the pressure reduction end timing t1.

As shown in FIG. 10, if the post injection amount is large, when the post injection is performed, the inlet pressure of the injector 9 may lower below the predetermined low pressure PL1. In such a case, as shown in FIG. 10, if the change-over valve 5 is opened for the time responsive to the difference between the actual measurement value of the inlet pressure of the injector 9 and the predetermined low pressure PL1 and to the actual pressure PHP of the high-pressure accumulator 3, the inlet pressure of the injector 9 is compensated for and is restored to the predetermined low pressure PL1. Accordingly, the inlet pressure of the injector 9, namely, the fuel pressure in the fuel passage 10*a* is held at the pressure reduction end timing t1 until the next initial injection is performed after the post injection terminates, and the initial injection is always executed at appropriate fuel pressure. Accordingly, the predetermined low pressure PL1 is provided and better main combustion can be accomplished.

On the other hand, in this example, as in the first embodiment, the start pressure of the post injection is larger than the predetermined low pressure PL1, but becomes the minimum pressure for providing the predetermined low pressure PL1 as the initial injection.

Therefore, in the second embodiment, while the predetermined low pressure PL1 is always reliably provided as the injection pressure of the initial injection, the penetration of the injected fuel can be minimized as much as possible and it is made possible to well prevent the fuel from adhering to the cylinder liner wall.

Thus, while better main combustion is accomplished and oil dilution, seizure, etc., is well prevented, the exhaust temperature can be raised and by extension the oxidation catalyst 1*c* can be activated early.

In place of the step 32 of the second embodiment, the following step may be performed. Namely, in the second embodiment, the pressure component below the predetermined low pressure PL1 as the post injection is performed is restored to the predetermined low pressure PL1 as the change-over valve 5 is temporarily opened. Thus, the second embodiment has a large feature that the post injection can be executed when the inlet pressure of the injector 9 lowers to the predetermined low pressure PL1.

Therefore, in the second embodiment, the post injection is executed when the inlet pressure of the injector 9 lowers once to the predetermined low pressure PL1, and the pressure lowered by the post injection from the predetermined pressure PL1 is restored to the predetermined pressure PL1 by temporarily opening the change-over valve 5. Thus, while the predetermined low pressure PL1 is always reliably provided as the injection pressure of the initial injection, the penetration of the injected fuel at the post injection start timing can be minimized reliably and it is made possible to well prevent the fuel from adhering to the cylinder liner wall and accomplish the optimum post injection.

Moreover, in the second embodiment, the exhaust stroke end timing t2 after the inlet pressure of the injector 9 is lowered once to the predetermined low pressure PL1 may be set as the fuel injection end timing, tpost-end. In this case, oil dilution, seizure, etc. can be well prevented.

It is to be understood that the invention is not limited to the embodiments described above.

For example, the embodiments are intended for raising the temperature of the oxidation catalyst 1*c* and activating the oxidation catalyst 1*c*, but the catalyst to be activated is not limited to the oxidation catalyst 1*c* and if an NOx catalyst, etc., is placed on the exhaust passage 1*b*, the invention can be well applied.

The embodiments are intended for raising the temperature of the catalyst and activating the catalyst, but the invention can also be applied to post injection intended for burning and removing PM deposited on a DPF.

What is claimed is:

1. An accumulator type fuel injection apparatus comprising:

a first accumulator for accumulating high-pressure fuel having high pressure pressurized by a pump;

a fuel injection nozzle connected to the first accumulator via a fuel passage, the fuel injection nozzle for injecting fuel into a combustion chamber of an engine;

a change-over valve for communicating the high-pressure fuel in the first accumulator with the fuel passage and shutting off communication of the high-pressure fuel between the first accumulator and the fuel passage;

a second accumulator connected to the fuel passage downstream of the change-over valve via a branch passage, the second accumulator for accumulating low-pressure fuel having low pressure lower than the high pressure of the high-pressure fuel in the first accumulator;

a pressure control valve provided at one of the fuel passage downstream of the change-over valve and the second accumulator, the pressure control valve for adjusting fuel pressure in the fuel passage and the second accumulator;

an on-off valve for controlling fuel injection from the fuel injection nozzle;

main injection control means for controlling the change-over valve and on-off valve to inject main fuel from the fuel injection nozzle during a predetermined period of time according to an operation condition of the engine; and post injection control means for controlling the on-off valve to inject additional fuel from the fuel injection nozzle, after the injection of the main fuel by the main injection control means, thereby to raise exhaust temperature of the engine, wherein the post injection control means injects the additional fuel so that the injection terminates at one of a first timing and second timing, whichever earlier, at the first timing, the fuel pressure of the one of the fuel passage and second accumulator is lowered at a predetermined pressure lower than the high-pressure in the first accumulator, and at the second timing, an exhaust stroke of the engine is completed.

2. The accumulator type fuel injection apparatus according to claim 1, wherein the pressure control valve adjusts the fuel pressure in the fuel passage and second accumulator to be the predetermined pressure after one of timings at which the main injection control means completes the injection of the main fuel and at which the change-over valve is switched to shutoff the communication after the completion of the injection of the main fuel.

3. The accumulator type fuel injection apparatus according to claim 1, further comprising pressure adjustment means for controlling the pressure control valve to adjust the fuel pressure in the fuel passage and second accumulator to be the predetermined pressure, wherein the pressure adjustment means controls the pressure control valve to lower the fuel pressure in the one of the fuel passage and second accumulator to be the predetermined pressure after one of timings at which the main injection control means completes the injection of the main fuel and at which the change-over valve is switched to shutoff the communication after the completion of the injection of the main fuel.

4. The accumulator type fuel injection apparatus according to claim 1, wherein the post injection control means comprises pressure reduction timing calculation means for calculating a pressure reduction period of time until the fuel pressure in the one of the fuel passage and second accumulator is to be the predetermined pressure, the pressure reduction timing calculation means for calculating a pressure reduction end timing based on a timing of switching the change-over valve to the shutoff condition, after one of timings at which the main injection control means completes the injection of the main fuel and at which the change-over valve is switched to shutoff the communication after the completion of the injection of the main fuel.

5. The accumulator type fuel injection apparatus according to claim 1, wherein the post injection control means sets the first timing to be the injection end timing when an engine rotation of the engine is equal to or lower than a predetermined engine rotation; and the post injection control means sets the second timing to be the injection end timing when the engine rotation of the engine exceeds the predetermined engine rotation.

6. An accumulator type fuel injection apparatus comprising:

a first accumulator for accumulating high-pressure fuel having high pressure pressurized by a pump;

a fuel injection nozzle connected to the first accumulator via a fuel passage, the fuel injection nozzle for injecting fuel into a combustion chamber of an engine;

a change-over valve for communicating the high-pressure fuel in the first accumulator with the fuel passage and shutting communication of the high-pressure fuel off between the first accumulator and the fuel passage;

a second accumulator connected to the fuel passage downstream of the change-over valve via a branch passage, the second accumulator accumulating low-pressure fuel having low pressure lower than the high-pressure fuel in the first accumulator;

a pressure control valve provided at one of the fuel passage downstream of the change-over valve and the second accumulator, the pressure control valve for adjusting fuel pressure in the fuel passage and the second accumulator;

an on-off valve for controlling fuel injection from the fuel injection nozzle;

main injection control means for controlling the change-over valve and on-off valve to inject main fuel from the fuel injection nozzle during a predetermined period of time according to an operation condition of the engine; and post injection control means for controlling the on-off valve to inject additional fuel from the fuel injection nozzle, after the injection of the main fuel by the main injection control means, thereby to raise exhaust temperature of the engine, pressure adjustment means for controlling the on-off valve to supply the high-pressure fuel in the first accumulator toward the fuel passage after the post injection control means injects the additional fuel by temporarily opening the on-off valve.

7. The accumulator type fuel injection apparatus according to claim 6, further comprising pressure detection means for detecting the fuel pressure in the one of the pressure passage and second accumulator, wherein the pressure adjustment means controls the on-off valve to set the fuel pressure in the one of the fuel passage and second accumulator to be a predetermined pressure lower than the fuel pressure in the first accumulator.

8. The accumulator type fuel injection apparatus according to claim 6, wherein the post injection control means injects the additional fuel so that the injection terminates at one of a first timing and second timing, whichever earlier, at the first timing, the fuel pressure of the one of the fuel passage and second accumulator is lowered at a predetermined pressure lower than the high-pressure in the first accumulator, and at the second timing, an exhaust stroke of the engine is completed.

9. An accumulator type fuel injection apparatus comprising:

a first accumulator for accumulating high-pressure fuel having high pressure pressurized by a pump;

a fuel injection nozzle connected to the first accumulator via a fuel passage, the fuel injection nozzle for injecting fuel into a combustion chamber of an engine;

a change-over valve for communicating the high-pressure fuel in the first accumulator with the fuel passage and shutting off communication of the high-pressure fuel between the first accumulator and the fuel passage;

a second accumulator connected to the fuel passage downstream of the change-over valve via a branch passage, the second accumulator adapted to accumulate low-pressure fuel having low pressure lower than the high pressure of the high-pressure fuel in the first accumulator;

a pressure control valve provided at one of the fuel passage downstream of the change-over valve and the second accumulator, the pressure control valve for adjusting fuel pressure in the fuel passage and the second accumulator; and an on-off valve for controlling fuel injection from the fuel injection nozzle, wherein the fuel injection nozzle injects main fuel from the fuel injection nozzle during a predetermined period of time according to an operation condition of the engine;

the fuel injection nozzle injects additional fuel from the fuel injection nozzle, after the injection of the main fuel, thereby to raise exhaust temperature of the engine;

the injection of the additional fuel terminates at one of a first timing and second timing, whichever earlier, at the first timing, the fuel pressure of the one of the fuel passage and second accumulator lowers to a predetermined pressure lower than the high-pressure in the first accumulator, and at the second timing, an exhaust stroke of the engine is completed.

10. An accumulator type fuel injection apparatus comprising:

a first accumulator for accumulating high-pressure fuel having high pressure pressurized by a pump;

a fuel injection nozzle connected to the first accumulator via a fuel passage, the fuel injection nozzle for injecting fuel into a combustion chamber of an engine;

a change-over valve for communicating the high-pressure fuel in the first accumulator with the fuel passage and shutting communication of the high-pressure fuel off between the first accumulator and the fuel passage;

a second accumulator connected to the fuel passage downstream of the change-over valve via a branch passage, the second accumulator accumulating low-pressure fuel having low pressure lower than the high-pressure fuel in the first accumulator;

a pressure control valve provided at one of the fuel passage downstream of the change-over valve and the second accumulator, the pressure control valve for adjusting fuel pressure in the fuel passage and the second accumulator;

an on-off valve for controlling fuel injection from the fuel injection nozzle, wherein the change-over valve and on-off valve inject main fuel from the fuel injection nozzle during a predetermined period of time according to an operation condition of the engine; and the on-off valve injects additional fuel from the fuel injection nozzle, after the injection of the main fuel, thereby to raise exhaust temperature of the engine, the on-off valve supplies the high-pressure fuel in the first accumulator toward the fuel passage after the on-off valve injects the additional fuel by temporarily opening the on-off valve.

* * * * *